US010820759B2

(12) United States Patent
Houska

(10) Patent No.: US 10,820,759 B2
(45) Date of Patent: Nov. 3, 2020

(54) CHAIR FOR PERSONAL RELIEF

(71) Applicant: Tina Houska, St. Louis, MO (US)

(72) Inventor: Tina Houska, St. Louis, MO (US)

( * ) Notice: Subject to any disclaimer, the term of this patent is extended or adjusted under 35 U.S.C. 154(b) by 16 days.

(21) Appl. No.: 15/900,267

(22) Filed: Feb. 20, 2018

(65) Prior Publication Data

US 2018/0235415 A1 Aug. 23, 2018

Related U.S. Application Data

(60) Provisional application No. 62/460,950, filed on Feb. 20, 2017.

(51) Int. Cl.
*A47K 11/04* (2006.01)

(52) U.S. Cl.
CPC ..... *A47K 11/04* (2013.01)

(58) Field of Classification Search
CPC ..... A47K 11/04
USPC ..... 4/483, 902
See application file for complete search history.

(56) References Cited

U.S. PATENT DOCUMENTS

| | | | | | |
|---|---|---|---|---|---|
| 216,863 | A * | 6/1879 | Kienzle | A47K 11/04 | 4/483 |
| 577,136 | A * | 2/1897 | Honeywell | A47K 11/04 | 4/483 |
| 2,153,866 | A * | 4/1939 | Hess | A47K 11/04 | 4/483 |
| 4,368,551 | A | 1/1983 | Cummings | | |
| 4,837,868 | A * | 6/1989 | Allen | A47K 11/04 | 4/483 |
| 5,359,737 | A * | 11/1994 | Hodge | A47K 11/04 | 4/483 |
| 7,779,489 | B2 * | 8/2010 | Finell | A47K 11/06 | 4/483 |
| 8,141,184 | B2 | 3/2012 | Mondrush | | |
| 8,434,171 | B2 | 5/2013 | Wang | | |
| 2007/0101487 | A1 | 5/2007 | Major | | |

* cited by examiner

*Primary Examiner* — Tuan N Nguyen
(74) *Attorney, Agent, or Firm* — Boudwin Intellectual Property; Daniel Boudwin

(57) ABSTRACT

A chair commode. The chair is designed to look like a functional, decorative furniture piece while providing the utility of a chair that a person can relieve himself or herself thereupon. The chair provides a seat with a hole to a seat housing. A removable bowl is disposed in the seat housing to receive objects passing through the hole.

11 Claims, 2 Drawing Sheets

CHAIR FOR PERSONAL RELIEF

CROSS REFERENCE TO RELATED APPLICATIONS

This application claims the benefit of U.S. Provisional Application No. 62/460,950 filed on Feb. 20, 2017. The above identified patent application is herein incorporated by reference in its entirety to provide continuity of disclosure.

BACKGROUND OF THE INVENTION

The present invention relates to a chair for personal relief. Physically-limited, ill or elderly individuals often have trouble moving their bodies to a standard toilet in a bathroom when they need to use the restroom. Thus, portable commodes and bedpans are utilized to help these individuals relieve themselves in an immediate location or vicinity. However, commodes and bed pans can be difficult, frustrating and unsanitary to use and are aesthetically unpleasant, carry a negative stigma and are difficult to keep obscured or hidden from sight.

Because of the forgoing disadvantages inherent in the known art, there exists a need for an apparatus that allows individuals the convenience of a toilet in a close proximity that can be adapted to resemble an ordinary chair.

SUMMARY OF THE INVENTION

In view of the foregoing disadvantages inherent in the known types of chairs for personal relief now present in the known art, the present invention provides a chair for personal relief wherein the same can be utilized for providing convenience for the user when requiring a convenient option for relieving herself or himself therein.

The present system comprises a chair for personal relief with a chair frame having a seat housing. The chair has a hole through the seat housing wherein a user may relieve himself or herself through the hole. A seat housing with an upper panel affixed to a lower panel via a sidewall defining an interior volume. The sidewall is tapered. A cover is configured to removably cover a front opening. A bowl is disposed in the housing and is configured to receive bodily waste therein.

It is therefore an object of the present invention to provide a new and improved chair for personal relief that has all of the advantages of the prior art and none of the disadvantages.

A further object of the present invention is to provide a backrest attached to the chair frame for increased comfort and usability.

Yet another object of the present invention is to provide a cushion configured to cover the chair frame for increased comfort and usability.

Still yet another object of the present invention is to provide a cushion with a protruding member integral therewith that is configured to cover the hole in the chair frame for increased stability when used as a standard chair.

A further object of the present invention is to provide a pair of armrests attached to the chair frame for increased comfort, usability and stability for a user seated thereon.

Yet another object of the present invention is to provide a cover that is configured to be removable by the action of a bar clasp fastener system for convenience and ease of use.

A further object of the present invention is to provide a cover having a knob of a front face thereof to provide for efficient opening and closing of the front opening to provide access to the housing.

Yet another object of the present invention is to provide a chair frame having at least one leg to provide additional stability and support to the chair.

A further object of the present invention is to provide a bowl that is removable so as to enable easier cleaning of the chair.

Other objects, features and advantages of the present invention will become apparent from the following detailed description taken in conjunction with the accompanying drawings.

BRIEF DESCRIPTION OF THE DRAWINGS

Although the characteristic features of this invention will be particularly pointed out in the claims, the invention itself and manner in which it may be made and used may be better understood after a review of the following description, taken in connection with the accompanying drawings wherein like numeral annotations are provided throughout.

DETAILED DESCRIPTION OF THE INVENTION

Figure 1:
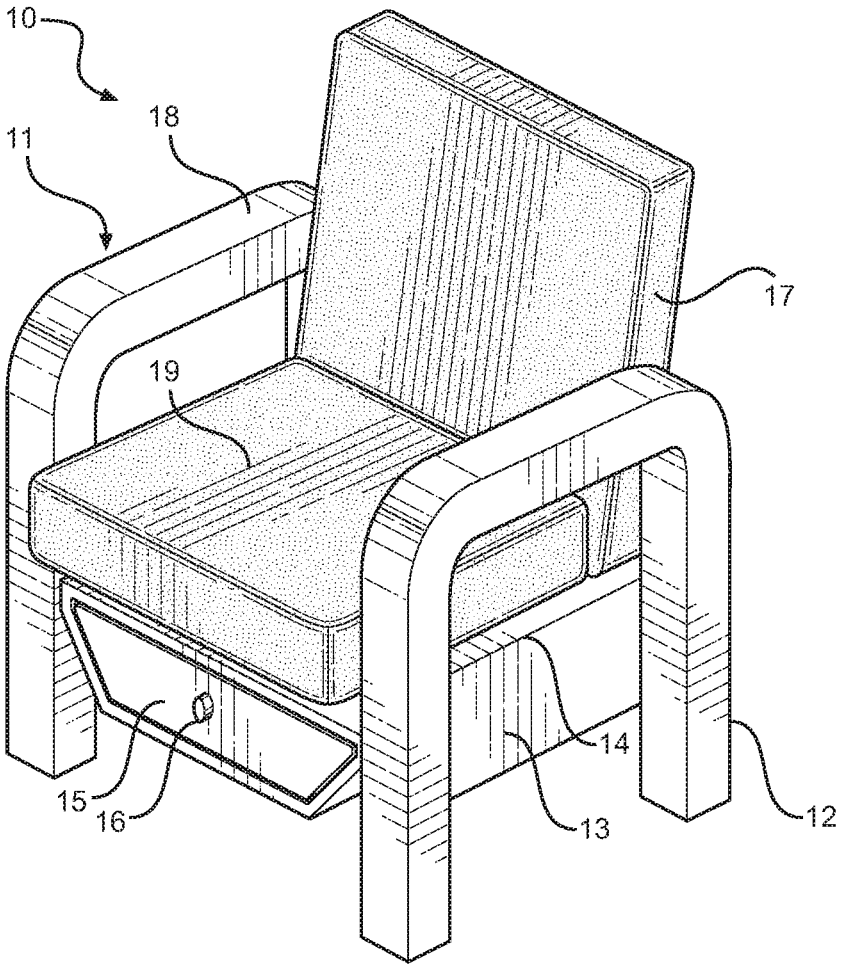
FIG. 1 shows a perspective view of an embodiment of the chair for personal relief.

Reference is made herein to the attached drawings. Like reference numerals are used throughout the drawings to depict like or similar elements of the chair for personal relief. The figures are intended for representative purposes only and should not be considered to be limiting in any respect.

Referring now to FIG. 1, there is shown a perspective view of an embodiment of the chair for personal relief. The chair for personal relief 10 is comprised of a chair frame 11. In one embodiment, at least one leg 12 extends downward toward a surface upon which the chair for personal relief 10 rests. A seat housing 13 includes an upper panel 14 of the chair frame 11. The seat housing 13 has a front opening and is defined by attachment of the upper panel 14 to a lower panel via a sidewall. The upper panel 14 is configured to receive the rear of a user thereon.

The sidewall is tapered such as to make the seat housing wider at the upper panel 14 than at the lower panel. This alignment of the upper panel 14 and lower panel is configured to provide additional comfort to the user.

In one embodiment, a cover 15 is configured to cover the front opening of the seat housing 13. Further under this embodiment, the cover 15 comprises a knob 16 on a central point thereon wherein the knob 16 is configured to enable a user to more easily pull the cover 15 off of the seat housing 13 to expose an interior volume therein.

In one embodiment, the chair frame 11 further comprises a backrest 17. The backrest 17 extends from the chair frame opposite of the plurality of legs 12. The backrest 17 is configured to receive a back of the user thereupon. In a further embodiment, the backrest 17 may be adjustable wherein the user can adjust the angle of the backrest relative to the seat portion 14. Under this embodiment, the backrest 17 may be adjustable by a handle.

In another embodiment, the chair frame 18 further comprises a pair of armrests 18 attached to the chair frame 11.

The armrests 18 are configured to receive a pair of arms of the user thereon. The armrests are configured to provide additional comfort to the user.

In yet another embodiment, a cushion 19 is configured to be removably placed over the chair frame 11. In a further embodiment, the cushion 19 comprises a seat cushion and a back cushion. The cushion 19 is made of a soft material, such as foam or cloth.

Figure 2:
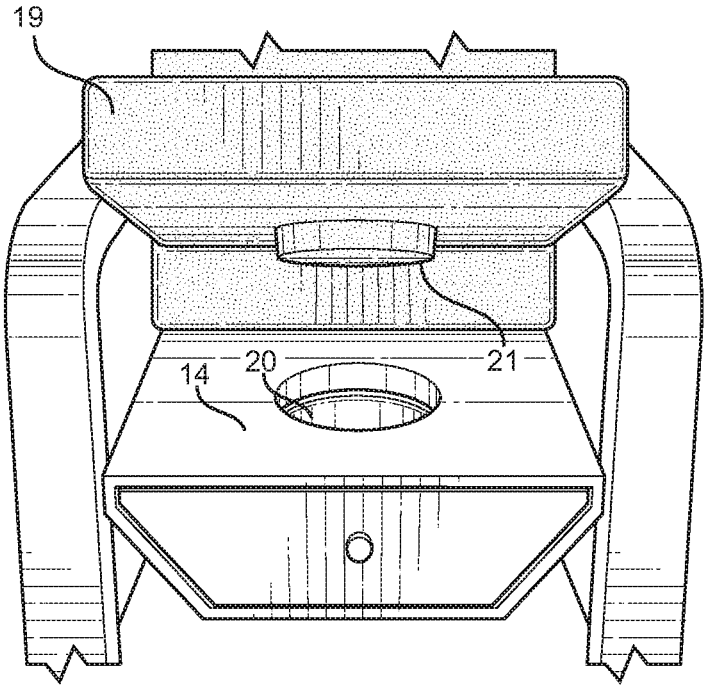
FIG. 2 shows a front view of an embodiment of the chair for personal relief.

Referring now to FIG. 2, there is shown a front view of an embodiment of the chair for personal relief. The upper panel 14 further comprises a hole 20 through a central portion thereof. The hole 20 is placed in the upper panel 14 in such a way to receive excretions of the user therethrough. In the shown embodiment, the hole 20 comprises a circular cross-section, however, in alternative embodiments, the hole 20 may have a oblong or polygonal cross-section.

In one embodiment, the cushion 19 comprises a protruding member 21 integral with the cushion 19 configured to be inserted or plugged into the hole when resting on the seat housing. The protruding member 21 is sized to be removably insertable into the hole 20. The protruding member 21 is configured to secure the cushion 19 in place upon the seat portion 14 such as to prevent sliding of the cushion 19.

Figure 3:
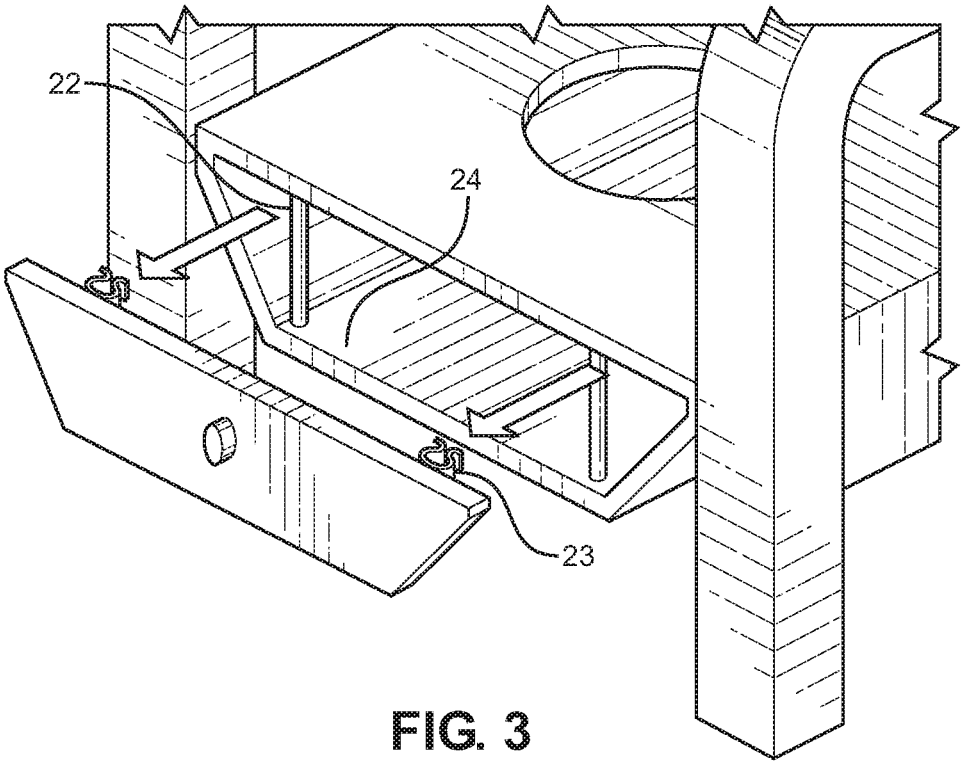
FIG. 3 shows a close-up view of the cover and front opening of an embodiment of the chair for personal relief.

Referring now to FIG. 3, there is shown a close-up view of the cover and front opening of an embodiment of the chair for personal relief. In one embodiment, the cover is removable from the seat housing via a bar clasp fastener system. The bar clasp fastener system comprises a plurality of bars 22 disposed within the seat housing, proximal to a tapered side wall thereof. Further under this embodiment, the cover comprises a plurality of clasps 23 disposed on a back side thereof. Each clasp of the plurality of clasps 23 is configured to correspond to a bar of the plurality of bars 22. Additionally, each clasp of the plurality of clasps 23 is configured to tensionably secure the cover to the front face of the housing such as to conceal an interior volume 24 thereof.

Figure 4:
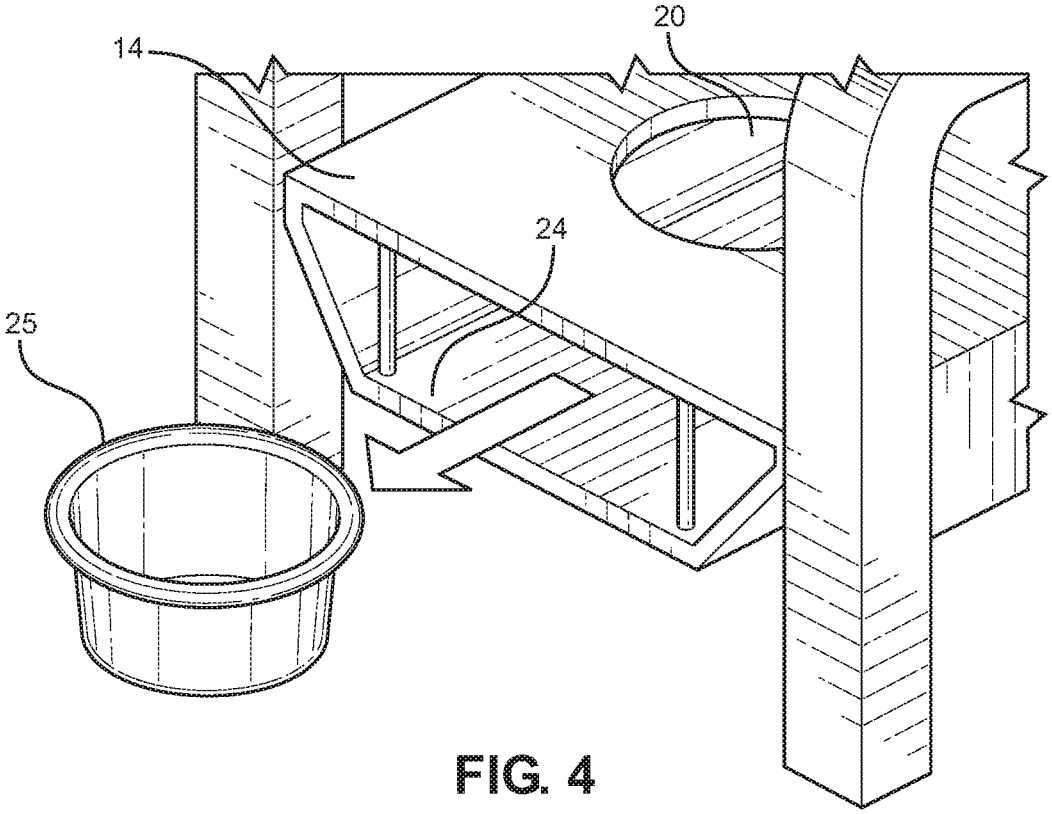
FIG. 4 shows a close-up view of the removable bowl of an embodiment of the chair for personal relief.

Referring now to FIG. 4, there is shown a close-up view of the removable bowl of an embodiment of the chair for personal relief. The chair for personal relief further comprises a bowl 25. The bowl 25 is configured to be placed in the seat housing such as to receive the excretions of a user therein. Furthermore, the bowl 25 is configured to be placed under the hole 20 such as to receive objects passing through the hole 20.

In one embodiment, the bowl 25 is configured to be removed from the front opening of the housing. In a further embodiment, at least one rail is disposed on a bottom surface of the housing such as to make the removable bowl slidable within the interior volume 24 of the seat housing.

It is therefore submitted that the instant invention has been shown and described in various embodiments. It is recognized, however, that departures may be made within the scope of the invention and that obvious modifications will occur to a person skilled in the art. With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A chair commode, comprising:

a chair frame having a seat housing with an upper panel affixed to a lower panel via a sidewall wherein the sidewall is tapered in a way to make the seat housing wider at an open upper end than at a bottom surface of the housing;

the seat housing defining an interior volume;

a bowl disposed within the interior volume;

a hole disposed through the upper panel, the hole configured to provide fluid communication between the bowl and an exterior of the upper panel;

a cover configured to removably cover a front of the seat housing;

the cover being entirely removable from the seat housing;

wherein the cover is configured to be removable by the action of a bar clasp fastener system comprising a pair of bars disposed on the front of the seat housing and a pair of clasps on a rear surface of the cover.

2. The chair commode of claim 1, further comprising a backrest attached to the chair frame extending opposite of one or more legs.

3. The chair commode of claim 1, further comprising a cushion configured to cover a seat rest of the chair frame.

4. The chair commode of claim 3, wherein the cushion further comprises a protruding member integral with the cushion configured to be inserted into the hole when resting on the seat housing.

5. The chair commode of claim 1, further comprising a pair of arm rests attached to the chair frame.

6. The chair commode of claim 1, wherein the cover has a knob disposed on a front face thereof.

7. The chair commode of claim 1, wherein the chair frame further comprises a leg.

8. The chair commode of claim 1, wherein the chair frame further comprises a plurality of legs thereon.

9. The chair commode of claim 1, wherein the bowl is configured to be removable.

10. A chair commode, comprising:

a chair frame having a seat housing with an upper panel affixed to a lower panel via a sidewall wherein the sidewall is tapered in a way to make the seat housing wider at an open upper end than at a bottom surface of the housing;

a backrest attached to the chair frame extending opposite of one or more legs;

the seat housing defining an interior volume;

a bowl disposed within the interior volume;

a hole disposed through the upper panel, the hole configured to provide fluid communication between the bowl and an exterior of the upper panel;

a cover configured to removably cover a front of the seat housing;

a cushion configured to cover the seat housing and the backrest of the chair frame;

wherein the cushion further comprises a protruding member integral with the cushion and configured to be inserted into the hole when resting on the seat housing;

wherein the cover is configured to be removable by the action of a bar clasp fastener system comprising a pair of bars disposed on the front of the seat housing and a pair of clasps on a rear surface of the cover.

11. A chair commode, consisting of:

a chair frame having a seat housing with an upper panel affixed to a lower panel via a sidewall wherein the sidewall is tapered in a way to make the seat housing wider at an open upper end than at a bottom surface of the housing;

a backrest attached to the chair frame extending opposite of one or more legs;

the seat housing defining an interior volume;

a bowl disposed within the interior volume;

a hole disposed through the upper panel, the hole configured to provide fluid communication between the bowl and an exterior of the upper panel;

a cover configured to removably cover a front of the seat housing;

a cushion configured to cover the seat housing and the backrest of the chair frame;

wherein the cushion further comprises a protruding member integral with the cushion and configured to be inserted into the hole when resting on the seat housing.

* * * * *